United States Patent [19]

Grözinger

[11] 4,332,150

[45] Jun. 1, 1982

[54] SYSTEM FOR CONTROLLING KNITTING OR WEAVING MACHINES FOR THE PRODUCTION OF RANDOMLY PATTERNED FABRIC

[75] Inventor: Gerhard Grözinger, Spaichingen, Fed. Rep. of Germany

[73] Assignee: SIPRA Patententwicklungs-und Beteiligungsgesellschaft mbH, Stuttgart, Fed. Rep. of Germany

[21] Appl. No.: 44,756

[22] Filed: May 30, 1979

[30] Foreign Application Priority Data

Jun. 3, 1978 [DE] Fed. Rep. of Germany ..... 2824486

[51] Int. Cl.[3] ..... D04B 15/78

[52] U.S. Cl. ..... 66/232; 66/218; 364/717; 139/319

[58] Field of Search ..... 66/215, 218, 219, 220, 66/221, 232, 75.2; 139/317 (U.S. only), 319; 364/470, 717

[56] References Cited

U.S. PATENT DOCUMENTS

| | | | |
|---|---|---|---|
| 3,670,527 | 6/1972 | Bourgeois | 66/232 |
| 3,844,139 | 10/1974 | De Cerjat et al. | 66/215 |
| 3,924,244 | 12/1975 | Seitz | 66/219 X |
| 3,963,905 | 6/1976 | Gopinath et al. | 364/717 |
| 3,969,912 | 7/1976 | Kouklik | 66/219 X |
| 4,007,607 | 2/1977 | Christiansen et al. | 66/219 X |
| 4,183,088 | 1/1980 | Simmons | 364/717 |

FOREIGN PATENT DOCUMENTS

| | | | |
|---|---|---|---|
| 1173620 | 12/1969 | United Kingdom | 66/232 |

*Primary Examiner*—Wm. Carter Reynolds
*Attorney, Agent, or Firm*—Michael J. Striker

[57] ABSTRACT

A knitting machine provided with patterning mechanisms responsive to pattern-control signals is caused to produce a non-repeating pattern by generating the pattern-control signals randomly, using a random signal generator not operating in synchronism with machine operation and generating potential pattern-control signals, from which actual pattern-control signals are derived in synchronism with machine operation. Although the pattern-control pulses are randomly generated, the overall character of the pattern produced can be altered by adjustment of the random signal generator to thereby alter the probabilities in the random generation of potential pattern-control signals. Also, pattern restraints are imposed upon the randomly produced pattern-control signals in both the horizontal and vertical directions, involving the number of consecutive stitches of a certain type that are to be permitted to adjoin in one course and in one wale, this being selectable in a manner not detracting from randomness.

12 Claims, 6 Drawing Figures

SYSTEM FOR CONTROLLING KNITTING OR WEAVING MACHINES FOR THE PRODUCTION OF RANDOMLY PATTERNED FABRIC

BACKGROUND OF THE INVENTION

The present invention concerns methods and systems for controlling the operations performed by knitting and weaving machines in the production of patterned fabric.

Control systems and methods for causing such machines to produce fabric in accordance with a preestablished pattern are of course well known. Particularly widespread use is made of mechanical patterning control systems, such as involve the use of jacquard cards, pattern wheels, or the like. It is also well known to electromechanically control the operations performed in accordance with pattern-control data stored in a mechanical or electronic storage. In all such cases, the pattern formed is determined by the basic pattern repeat, which is repeatedly produced, for example both vertically and horizontally in the case of a circular knitting machine.

It is known to produce crepe-like effects by resort to a basic pattern repeat of large dimensions and complex structure, so that although the basic pattern repeat is, in fact, merely repeated in the formation of the fabric, the impression of an unrepeated pattern be obtained; typically, unless the basic pattern repeat is of enormous dimension, a perceptive person can quickly see the nature of the repeat, usually by recognition of some very noticeable portion of the basic repeat and its corresponding location on an adjoining repeat.

SUMMARY OF THE INVENTION

It is the most general object of the invention to be able to produce knitted and woven fabric whose pattern exhibits no repeat whatsoever.

In accordance with the present invention, this is accomplished by using a random signal generator to randomly generate and/or randomly vary the pattern to be implemented.

In the preferred embodiment of the invention, potential pattern-control signals are randomly generated not in synchronism with machine operation, and in synchronism with machine operation signals are automatically selected from those randomly generated.

The present invention is applicable to both patterned weaving and patterned knitting. In the case of weaving machines, the extremes of patterning effects which can be obtained tend to be somewhat limited for reasons involving machine construction, e. g., the number of shuttles available, and so forth. The variability and randomness of the patterns which can be achieved on loop-forming machines, in contrast, tends inherently to be more nearly unlimited, especially with regard to multi-station circular knitting machines provided with electromechanical needle actuators, but also for various other types of knitting machines, including warp knitting machines.

The concept of randomly generating, without any machine synchronization, signals from which control signals are potentially to be derived, and then in synchronism with machine operation selecting from those the signals from which control signals are actually to be derived, is particularly advantageous; it assures that variations in the speed of machine operation not have an effect upon the random pattern being implemented.

In connection with the comment just made, it is to be noted that resort to truly random pattern generation and variation, in contrast to use of enormous repeats of complex structure intended to simulate pattern randomness, is an unusual concept. Although the pattern is to be randomly generated, this does not necessarily mean that it is to be permitted to form without any sort of control. Thus, with regard to the feature just mentioned, it is important, in order that the overall character of the random pattern be controlled, that machine-speed variations not influence the random pattern formed. Although random, the pattern will in general need to meet requirements of both an aesthetic and a technical character.

Thus, for example, if the pattern is exclusively a color pattern, it may be that, for the intended use of the resultant fabric, areas of a single color are not to be permitted to exceed a certain magnitude, for purely aesthetic reasons. If, for example, the pattern is exclusively determined by fabric structure, e.g., in the case of knit-and-tuck knitted ware, there are entirely practical limitations as to how many horizontally and/or vertically adjoining tuck stitches or tuck operations are to be permitted.

Thus, the present invention also provides means and technique for placing limits upon what can happen in the ongoing formation of a random pattern, without detracting in any way from the randomness of the pattern within such limits. Somewhat more generally, the present invention also provides means for altering overall pattern character, without departing from the randomness of the pattern. This will best be understood from the description of an exemplary embodiment, below.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
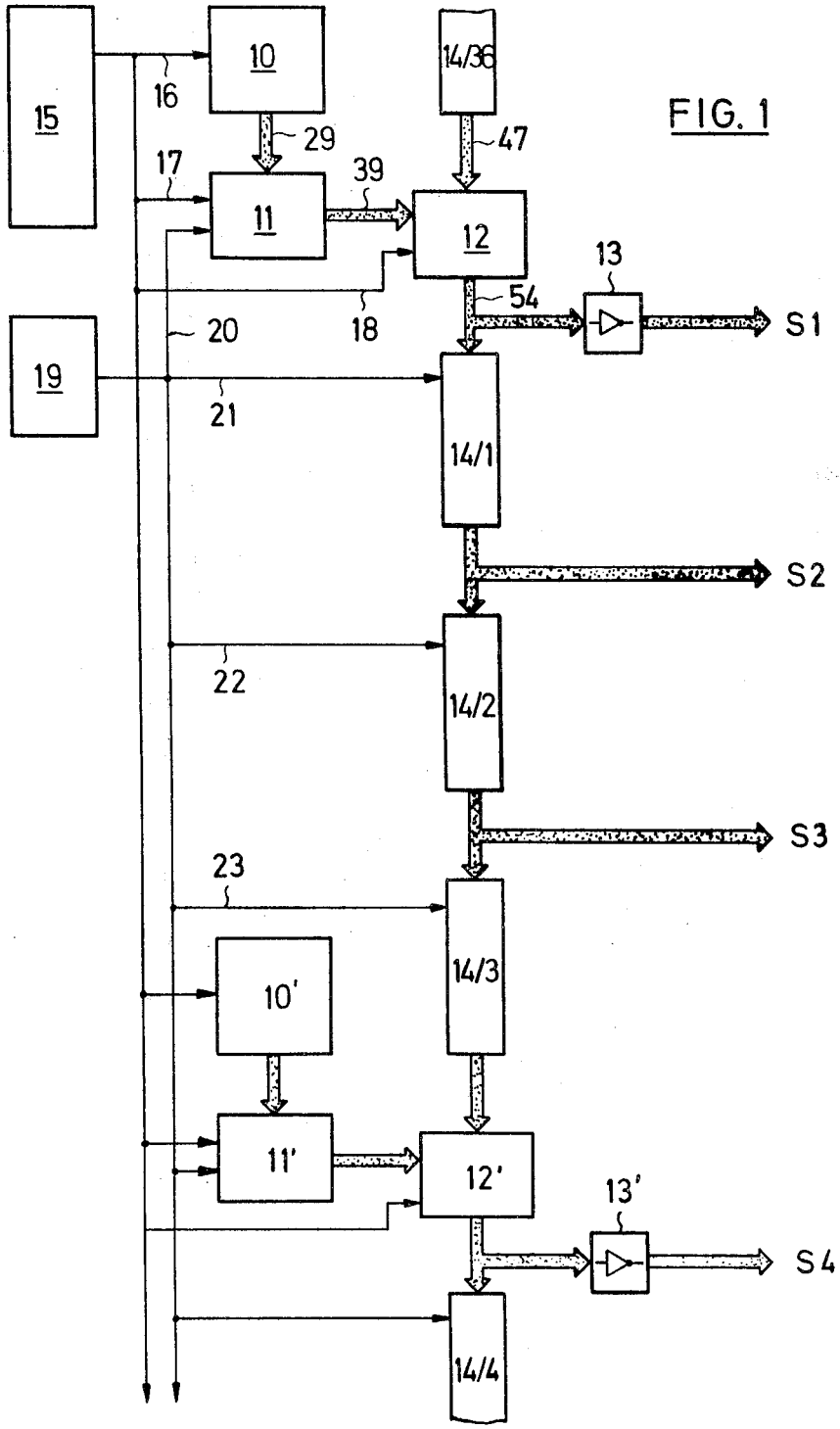
FIG. 1 is a schematic overall block diagram of an exemplary embodiment of a system generating pattern-control signals randomly in accordance with the present invention.

For explanatory purposes, FIG. 1 depicts, in schematic block diagram form, a pattern-control system for a circular knitting machine, but embodying the concepts of the present invention. For the sake of a concrete example, it is here assumed that the randomly patterned fabric structure to be formed is a crepe-like knit formed by resort to so-called double-relief patterning, with each individual course of the fabric being produced by three successive yarn-feeding stations, hereafter referred to as knitting stations, acting in cooperation, with special relief yarns being randomly added to form auxiliary loops along with the main yarns by random selection of needles. The control signals furnished by the illustrated system are transmitted to electromechanical needle selectors, such electromechanical selectors being conventional and familiar to persons skilled in the art. In particular, the signals produced by the illustrated pattern-control system in the explanatory example to be described determine whether, at the knitting station to whose needle selectors the signals are applied, a loop or stitch of relief yarn is or is not to be formed. The entire pattern-control system comprises a succession of subsystems, one per course to be produced. Because each course is produced by three knitting stations acting in cooperation, there is one pattern-control subsystem for each three knitting stations. Here, for explanatory purposes, it is assumed that a 36-station machine is involved, and that accordingly twelve pattern-control subsystems are utilized. The interconnections as among the twelve subsystems will be described in detail.

Each pattern-control subsystem comprises a respective random signal generator 10. The latter furnishes pulses to a first, horizontal-direction pattern-limiting unit 11. Connected to the output of the first pattern-limiting unit 11 is a second, vertical-direction pattern-limiting unit 12. The pulses selected for use as pattern-control pulses are transmitted from the output of second pattern-limiting unit 12 to the needle-selector mechanism S1 of the first knitting station of the machine, via an inverter 13. The pattern-control pulses from second pattern-limiting unit 12 are furthermore transmitted via an open (as opposed to circulating) shift register 14/1 to the needle-selector mechanism S2 of the second knitting station of the machine. From the output of shift register 14/1, the selfsame pattern-control pulses are transmitted via a next such shift register 14/2 to the needle-selector mechanism S3 of the third station of the machine; and via the next such shift register 14/3 to the input of the second, vertical-direction pattern-limiting unit 12' of the second such pattern-control subsystem, associated with the needle-selector mechanisms S4, S5 and S6 of the fourth, fifth and sixth knitting stations of the machine. This second pattern-control subsystem is explicitly illustrated only to the extent of its random signal generator 10', its first and second pattern-limiting units 11' and 12', its inverter 13' and the first of its shift registers 14/4. The twelfth of the twelve pattern-control subsystems is explicitly illustrated only to the extent of its terminal shift register 14/36, which supplies input signals to the second pattern-limiting unit 12 of the first pattern-control subsystem.

In the drawings, the main flows of pattern-control information and potential pattern-control information are indicated in accordance with convention by broad arrows, whereas the narrow-line arrows indicate the transmission of switching signals and control signals employed to control operations performed by the various individual units of the system. All such control and switching signal lines in FIG. 1 emanate from a manual-input keyboard unit 15 and a machine synchronizer 18. The switching signal lines from keyboard unit 15 are denoted 16, 17 and 18. The machine synchronizer 19 generates pulses synchronized with increments of needle-cylinder rotation. From synchronizer 19 a control line 20 leads to the first pattern-limiting unit 11 of the first pattern-control subsystem, and likewise to unit 11' of the second subsystem, etc. Also, control lines 21, 22, 23 lead from synchronizer 19 to the shift-signal inputs of the three shift registers 14/1, 14/2, 14/3, and likewise to those of the other shift registers 14/4 through 14/36.

The units 10, 11 and 12 are described in detail below, in connection with subsequent Figures. The keyboard unit 15, shared by all subsystems in common, comprises a set of selector switches used to preset certain values in circuit components yet to be described.

The machine synchronizer 19 can be a conventional needle-interval synchronizer, located at the slotted region of the machine's rotating needle cylinder and operative for generating one pulse for each needle or slot which passes it.

The open (in contrast to circulating) shift registers 14/1 to 14/36 serve to transmit pattern-control pulses from one knitting station to the next, in synchronism with needle-cylinder rotation. Each shift register 14/n consists of a number of shift-register stages equal to the number of interneedle intervals between, on the one hand, the knitting station associated with the shift register and, on the other hand, the adjoining knitting station. Because the spacing between each two adjoining knitting stations may not be identical all around the circumference of the machine's needle cylinder, the shift registers 14/n, in correspondence thereto, may not all consist of the same number of shift-register stages. When a pattern-control pulse is transmitted from the output of the first pattern-limiting unit 12 of the first pattern-control subsystem to the needle-selection mechanism S1 of the first knitting station, it is simultaneously applied to and registered in the first stage of shift register 14/1, and is then shifted, stage by stage, through register 14/1 in synchronism with needle-cylinder rotation, i.e., is shifted by one stage each time the cylinder rotates through an angle equal to the angular interneedle spacing. Accordingly, this pattern-control pulse, when applied from the terminal stage of shift register 14/1 to the needle-selector mechanism S2 of the second knitting station, will determine the operation of the selfsame needle whose operation it determined when that needle was previously at the first knitting station, the difference, however, is that when this one pattern-control pulse was applied to needle-selection mechanism S1 this was done through the intermediary of inverter 13. This one pattern-control pulse then enters into and shifts along shift register 14/2, so that when the same needle reaches the needle selector mechanism S3 at the third knitting station it will again be controlled in accordance with this pattern-control pulse.

Figure 2:
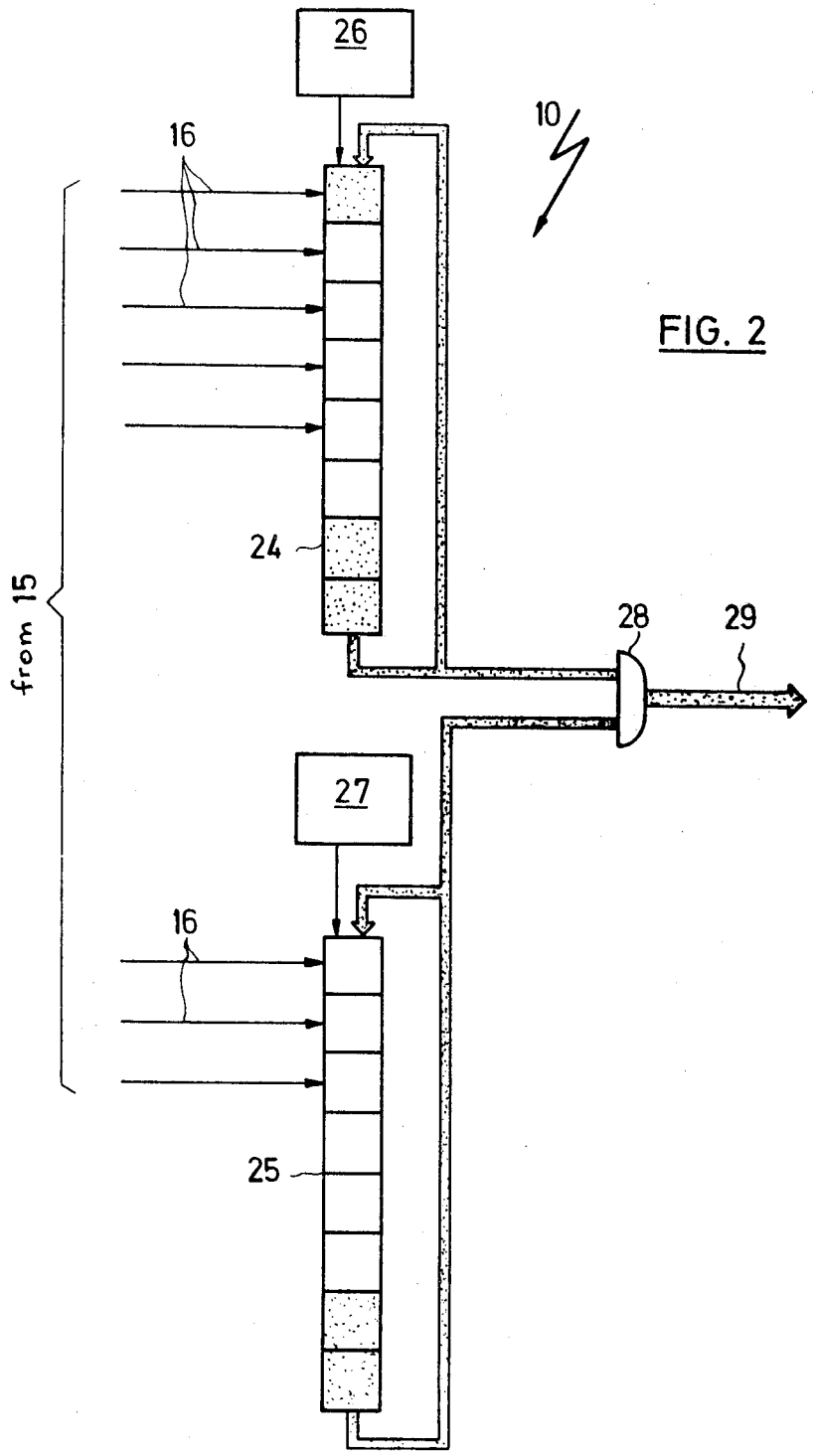
FIG. 2 depicts the internal configuration of the random signal generator 10 of FIG. 1.

FIG. 2 depicts the internal configuration of the random signal generator unit 10 of FIG. 2. It comprises two shift registers 24, 25 each having, by way of example, eight shift-register stages. Each shift register is shifted by a respective pulse generator 26 or 27 operating at different respective frequencies and independently of each other and of the machine synchronizer 19. The two shift registers 24, 25 are connected as circulating memories, i.e., the datum in the last stage of each shift register is, upon receipt of the next shift pulse, registered in the first stage, as indicated by the broad information-flow arrows in FIG. 2. The individual stages of the two shift registers 24, 25 are connected via control lines 16, already referred to in connection with FIG. 1, to the shared keyboard unit 15 of the system. Keys on the keyboard can be used to preestablish the number of "1" bits memorized in each shift register 24, 25 for the production of a pattern. In FIG. 2, the presence of a "1" bit in a shift-register stage is indicated by the shading. In the illustrated instance, shift register 24 registers only three "1" signals, respectively registered by the first, seventh and eighth shift-register stages at the moment illustrated in FIG. 2, whereas shift register 25 registers two "1" signals presently registered at the seventh and eighth stages at the moment illustrated.

The "1" bits registered in the two shift registers 24, 25 circulate within the respective shift register at differing speeds. The last stage of each of the two shift registers is connected to a respective one of the two inputs of an AND-gate 28 whose output line 29, as shown in FIG. 1, leads to the first pattern-limiting unit 11 of the associated pattern-control subsystem. A "1" bit is produced on output line 29 only when, simultaneously, a "1" bit is instantaneously registered at the output stages of both shift registers 24, 25. Because the frequencies of the two pulse generators 26, 27 are different and in no way synchronized with each other, the production of "1" bits on output line 29 is made random, in a simple way. Although the production of "1" bits is random, the keyboard unit 15 can be utilized to increase and decrease the overall probability that a "1" bit will be produced at output line 29; at one extreme, storage of eight "1" bits by each of the two shift registers 24, 25 would result in uninterrupted production of an output "1" bit, whereas storage of fewer than eight "1" bits in either of the two shift registers decreases the probability of the production of an output "1" bit; and so forth. FIG. 2 depicts a moment at which an output "1" bit is being produced.

Figure 3:
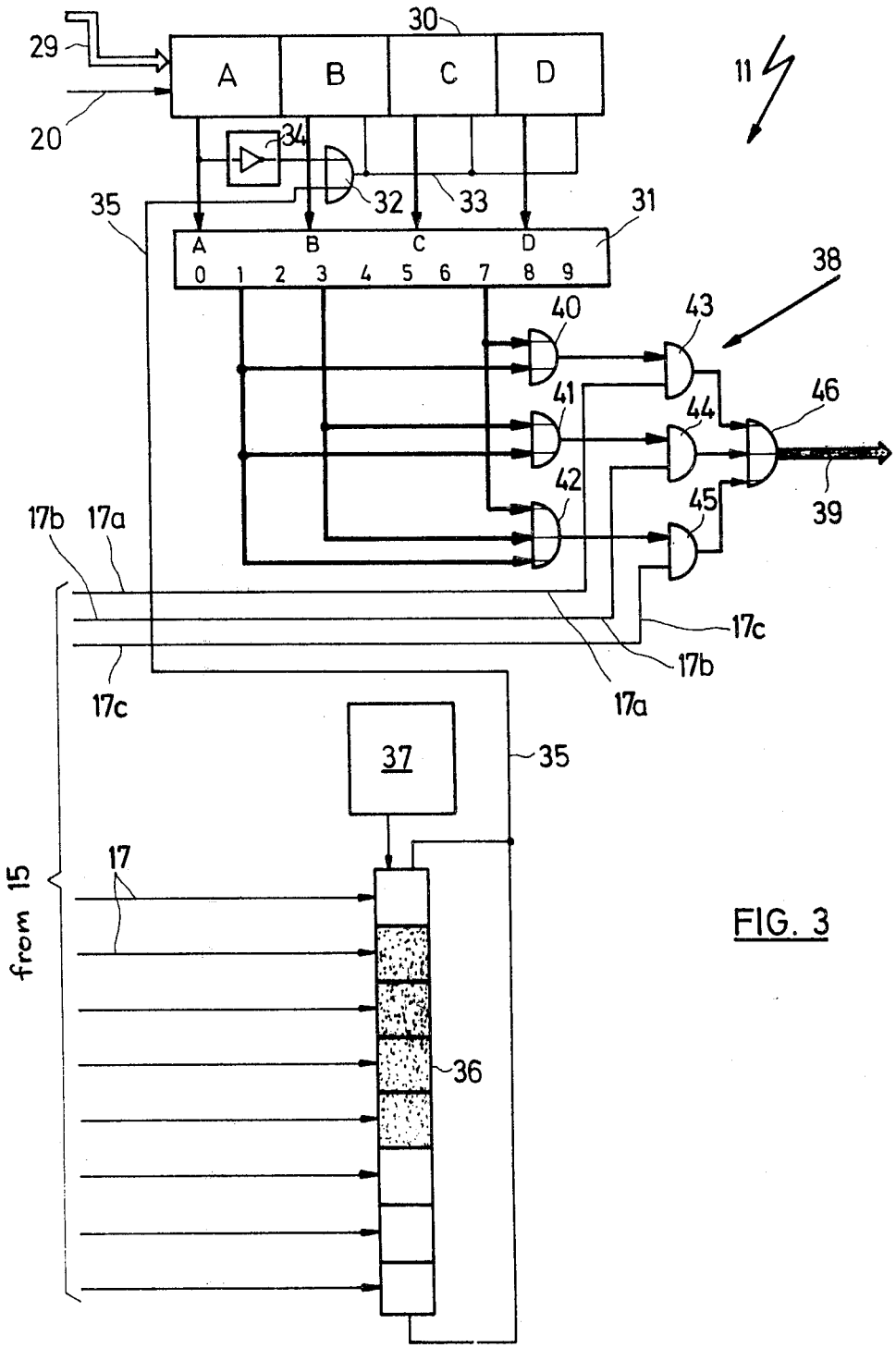
FIG. 3 depicts the internal configuration of the horizontal-direction pattern-limiting unit 11 of FIG. 1.

FIG. 3 depicts the internal configuration of the first, horizontal-direction pattern-limiting unit 11 of FIG. 1. Its operation is described below, with respect to the bit waveforms and state tabulations of FIG. 4 and 5. The first pattern-limiting unit 11 comprises an open shift register 30 comprised of four stages A, B, C, D. The data input of shift register 30 receives the output bits from output line 29 of the random signal generator 10. The shift-pulse input of shift register 30 receives machine-synchronized pulses via line 20 from machine synchronizer 19, one per rotation of the machine's needle cylinder through one interneedle interval. The bit registered by each stage A, B, C, D of shift register 30 is applied to a respective input (likewise denoted A, B, C, D) of a binary to 1-out-of-16 decoder 31. The decoder 31 has sixteen output lines of which only the first ten are shown in FIG. 3, and denoted 0 through 9; furthermore of these, only output lines 1, 3 and 7 are actually utilized. The decoder 31 converts the 4-bit number which is at any given time registered by shift register 30 into a "1" bit produced on one of its output lines. If the 4-bit number registered on register 30 is 0000, a "1" bit is produced only on output line 0 of decoder 31. If shift-register stages A, B, C, D, respectively register the bits "1", "0", "0" and "0", i.e., if register 30 registers the 4-bit number 0001, then a "1" bit is produced only at the 1-output of decoder 31. If shift register stages A, B, C, D respectively register the bits "1", "1", "0" and "0", i.e., if register 30 registers the 4-bit number 0011, then a "1" bit is produced only at the 3-output of decoder 31. If shift register 30 registers the 4-bit number 0111, with the "0" bit thereof registered on stage D, then a "1" bit is produced only at the 7-output of decoder 31.

The reset inputs of the shift-register stages B, C and D of register 30, but not that of stage A, are connected in common via a reset line 31 to the output of an OR-gate 32. The upper input of OR-gate 32 is connected, via an inverter 34, to the data output of shift-register stage A. The lower input of OR-gate 32 is connected via a line 35 to the data output of the last shift-register stage of a recirculating shift register 36.

The shift register 36 of the pattern-limiting unit 11 introduces further randomness, but of selectable character, into the generation of the ultimate pattern-control pulses. Here, by way of example, register 36 comprises eight stages and, like the shift registers 24, 25 of random signal generator 10, is shifted by its own separate pulse generator 37, unsynchronized with those driving registers 24, 25 and unsynchronized with machine operation. Here again, how many "1" bits are registered by shift register 36 during operation is selectable, via lines 17 leading to the keyboard unit 15. In the explanatory instance illustrated, register 36 stores four "1" bits, registered in the second through fifth stages of register 36 at the moment illustrated. The appearance of a "1" bit at the data output of the eighth stage of shift register 36 results, via OR-gate 32 and resetting line 33, in the immediate resetting of stages B, C, and D of shift register 30, i.e., the registration of "0" bits by those three stages, but without any effect upon the bit registered by stage A of register 30.

The 1-, 3- and 7-outputs of decoder 31 are connected to the actual output line 39 of the illustrated pattern-limiting unit 11 through the intermediary of a logic-gage network 38. As shown in FIG. 1, the output line 39 of pattern-limiting unit 11 is connected to the input of the second, vertical-direction pattern-limiting unit 12. The logic-gate network 38 comprises a first stage made up of three OR-gates 40, 41, 42, a second stage made up of three AND-gates 43, 44, 45, and a third stage consisting of an OR-gate gate 46. It will be appreciated by persons skilled in the art that the input-signal/output-signal relationships implemented by this interconnection of particular gates can be implemented by functionally equivalent but different interconnections as among other such gates; likewise, the input-signal/output-signal relationships implemented are capable of modification. In the illustrated embodiment, the logic-gate network 38 serves to implement the relationships depicted in FIGS. 4 and 5.

The two inputs of OR-gate 40 of the first stage of logic-gate network 38 are connected to the 1- and 7-outputs of decoder 31. The two inputs of OR-gate 41 are connected to the 1-output and to the 3-output of decoder 31. The three inputs of third OR-gate 42 are respectively connected to the 1-output, the 3-output and the 7-output of decoder 31.

The outputs of AND-gates 43, 44, 45 are connected to respective inputs of OR-gate 46, whose output constitutes the output line 39 of the first, horizontal-direction pattern-limiting unit 11 here illustrated.

The outputs of the three or-gates 40, 41, 42 are each connected to the upper input of a respective one of the three and-gates 43, 44, 45 of the second stage of logic-gate network 38. The lower inputs of the three and-gates 43, 44, 45 are connected via respective lines 17*a*, 17*b*, 17*c* to the keyboard unit 15. The keyboard unit 15 is provided with a 3-position selector switch, or the equivalent, which applies a persistent "1" signal to the lower input of a selected one of the three and-gates 43, 44, 45, enabling only that single one of the three and-gates for operation.

The 3-position selector switch at keyboard unit 15 serves to determine the maximum number of immediately adjoining wales in one course in which a relief-thread stitch will be produced. In one setting, as many as three immediately adjoining relief-thread stitches are permitted to form; in another setting, a maximum of two; in a third setting, relief-thread stitches are never permitted to be produced in immediately adjoining wales of the same course. This is a limitation upon the randomly produced, pattern and it is a limitation which relates to the pattern as considered in the horizontal direction; hence the nomenclature horizontal-direction pattern-limiting unit 11. Although these are selectable horizontal-direction restraints upon the randomly produced pattern, it will be understood that the imposition of limitations or restraints upon a randomly generated situation does not nullify the randomness of the situation within those restraints.

As pulses arrive irregularly via line 29 from random signal generator 10, they are applied to the data input of the input stage A of shift register 30. These applied input pulses are not actually registered by input stage A, except at those instants at which a machine-synchronized pulse is received via line 20 from machine synchronizer 19. Thus, of all the randomly produced bits applied to shift register 30, only some are actually written into the shift register, namely at the machine-synchronization instants. Bits are shifted through the successive stages of register 30 in synchronism with machine operation.

At any given instant, a "0" bit or else a "1" bit will be registered by each one of the four shift-register stages, A, B, C, D, constituting a 4-bit number corresponding to one of the decimal numbers 0 through 15, a "1" bit being produced on the corresponding one of the 1-out-of-16 output line system of decoder 31, as already explained.

In the illustrated embodiment, restraints are placed as to what 4-bit numbers can be registered by shift register 30.

Restraint upon the 4-bit numbers which can be registered by shift register 30 is implemented, in a first mode of operation, independently of shift register 36; and for purposes of explanation, line 33, leading from register 36 to OR-gate 32, can be imagined disconnected. In this mode of operation, when a "1" signal is applied to and registered in the first stage A of shift register 30, the resultant "0" bit produce at the output of inverter 34 fails to reset the other three shift-register stages B, C and D.

If the next bit registered by shift-register stage A is a "0" bit, then the resultant "1" bit produced at the output of inverter 34 resets the three stages, B, C, D, i.e., so that they each register a "0" signal. Accordingly, in this first mode of operation, each time a "0" signal is registered in first stage A, this causes the shift register 30 as a whole to register the 4-bit number 0000.

Thus, in this first mode of operation, if the number registered is 0000, and then, at the next machine-synchronized signal, a "1" bit is written into first register stage A, the number registered on register 30 becomes 0001. If then, at the next machine-synchronized signal, a "1" bit is again written into first register stage A, the number registered on register 30 becomes 0011. If then, the next bit written into stage A is, once more, a "1" bit, the number registered becomes 0111. If a still further "1" bit is written into stage A, the number registered becomes 1111. It still another "1" bit is written into stage A, the number registered continues to be 1111. If, at any point during this progression 0000, 0001, 0011, 0111, 1111, the bit written into stage "A" is a "0" bit, then the progression is discontinued and the number registered by register 30 is once more 0000.

Thus, in this mode of operation, the only numbers which can develop on shift register 30 are the five 4-bit numbers corresponding to the decimal numbers 0, 1, 3, 7 and 15. Furthermore, of the non-zero numbers, none can be registered (E.G., 7) unless the next-lower of these numbers (e.g., 3) has just previously been registered, i.e., in accordance with the progressive increase in the number of adjoining "1" bits which are registered in the four stages A, B, C, D of register 30. This is tabulated at 30 in FIG. 5.

Figure 5:
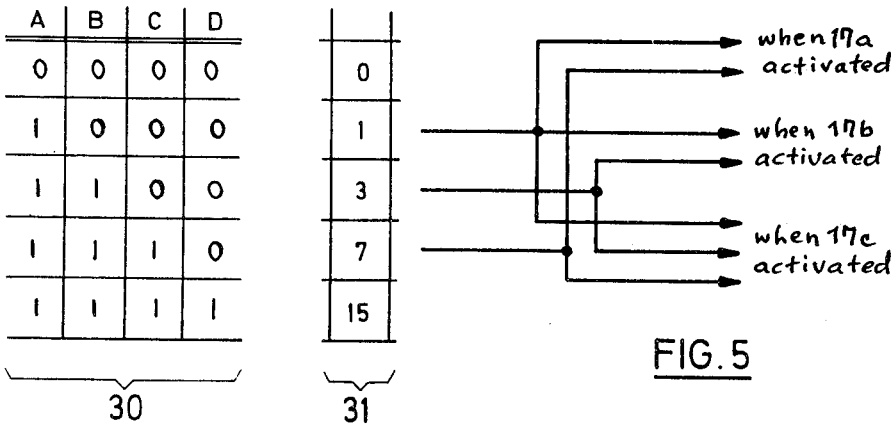
FIG. 5 is a tabulation of states of the shift register 30 and decoder 31 of FIG. 3.

Accordingly, in this first mode of operation, decoder 31 can produce an output "1" bit only on its 0-output, its 1-output, its 3-output, its 7-output, and its 15-output, the 15-output, however, not actually being utilized, as indicated at 31 in FIG. 5.

In the second mode of operation, the 4-bit numbers which can be registered on register 30 are limited to the two numbers 0000 and 0001, the stages B, C and D of register 30 being constrained to persistently register "0" bits, and only the state of stage A varying. This is accomplished by loading a "1" bit into each one of the eight stages of shift register 36, using keyboard unit 15. As a result, the terminal stage of shift register 36, via line 35 and OR-gate 32, persistently applies a "1" signal to the reset line 33 of stages B, C, D of register 30. Thus, in this mode of operation, decoder 31 can produce a "1" signal only on its 0-output and on its 1-output.

The logic-gate network 38 serves to establish how many consecutive pattern-control "1" bits are to be permitted to appear on output line 39 of the illustrated horizontal-direction pattern-limiting unit 11.

Let it be assumed that shift register 36 stores no "1" bit. Let it furthermore be assumed that a succession of "1" bits is registered by stage A of shift register 30, resulting in the progression 0000, 0001, 0011, 0111, 1111 as to the numbers registered, and in correspondence thereto resulting in the successive appearance of a "1" signal on the 0-, 1-, 3-, 7- and 15-output of decoder 31.

If the selector switch at keyboard unit 15 has been set to its no-adjoining-relief-stitch setting, an enabling "1" signal is applied via line 17*a* to the lower input of only AND-gate 43. When decoder 31 produces a "1" signal on its 1-output, this "1" signal is transmitted to output line 39. When, then, decoder 31 produces a "1" signal on its 3-output, this "1" signal is not transmitted to output line 39, because OR-gate 40 has no connection to the 3-output of decoder 31. When, then, decoder 31 produces a "1" signal on its 7-output, this "1" signal is transmitted to output line 39. Then, when decoder 31 produces a "1" signal on its 15-output, this "1" signal is not transmitted to output line 39, because indeed none of OR-gates 40–42 is connected to this decoder output. If register 30 continues to protractedly register the number 1111, because of a succession of further "1" bits registered by stage A, the decoder's output "1" bit stays at its 15-output. Another "1" bit will not be transmitted to the output line 39 until register 30 has registered the number 0000 and then the number 0001. Thus, relief stitches cannot be formed in adjoining wales. Horizontally, the closest that two relief stitches in one course can come is to be located one wale apart, i.e., with one wale between them containing no relief stitch.

If the selector switch at keyboard unit 15 has been set to its two-adjoining-relief-stitch setting, an enabling "1" signal is applied via line 17*b* to the lower input of only AND-gate 44. As the decoder's output "1" bit goes from its 0-output to its 1-output to its 3-output to its 7-output to its 15-output, this "1" bit is transmitted from the 1-output and the 3-output to the output line 39. Thus, relief stitches are produced in two adjoining wales of the same course. The "1" signal produced at the 7-output of decoder 31 is not transmitted to output line 39. Accordingly, more than two adjoining relief stitches cannot result in a single course.

If the selector switch at keyboard unit 15 is set to its three-adjoining-relief-stitch setting, an enabling "1" signal is applied to the lower input of only AND-gate 45. Accordingly, assuming that the output "1" bit of decoder 31 goes, in sequence, from its 0- to its 1- to its 3- to its 7- to its 15-output, due to consecutive registration of "1" signals by stage A of register 30, the decoder "1" bits at the 1-, 3- and 7-outputs thereof are transmitted to output line 39, with the result that relief stitches are found in three adjoining wales in one course. Again, a further "1" bit on line 39, and therefore a further relief stitch, will not be produced until stage A registers a "0" bit followed by a "1" bit, i.e., until the number registered by register 30 goes from 1111 to 0000 and then to 0001.

In the three instances just given, it is assumed that shift register 36 stores no "1" bit (and can therefore never reset stages B, C, D of register 30), and that a succession of "1" bits are registered by stage A of register 30. It will be clear that, due to randomness, such a succession of "1" bits will not in general be registered by stage A; thus, even when three adjoining relief stitches are permitted, this will actually happen only at times.

If, instead of storing no "1" bit, each stage of shift register 36 stores a "1" bit, then stages B, C, D of shift register 30 are persistently held reset, and only the state of stage A can change. When a "1" signal is registered by stage A, a "1" bit is produced on the 1-output of decoder 31, and is transmitted to output line 39, no matter which of the three AND-gates 43–45 is in receipt of an enabling "1" signal from keyboard unit 15. When a "0" bit is registered by stage A, a "1" bit is produced on the 0-output of decoder 31, and accordingly a "0" bit is furnished on output line 39. Thus, in this mode of operation, no horizontal-direction restraint of any kind is imposed on the randomly generated pattern; instead, the "1" and "0" bits registered by stage A, in synchronism with machine operation, are in effect merely transmitted to output line 39. This means that it can happen that a protracted succession of relief stitches might be produced in a single course, in immediately successive wales, in principle without limit; as will be understood, this may be undesirable for reasons of both aesthetics and fabric structure or machine operation.

Figure 4:
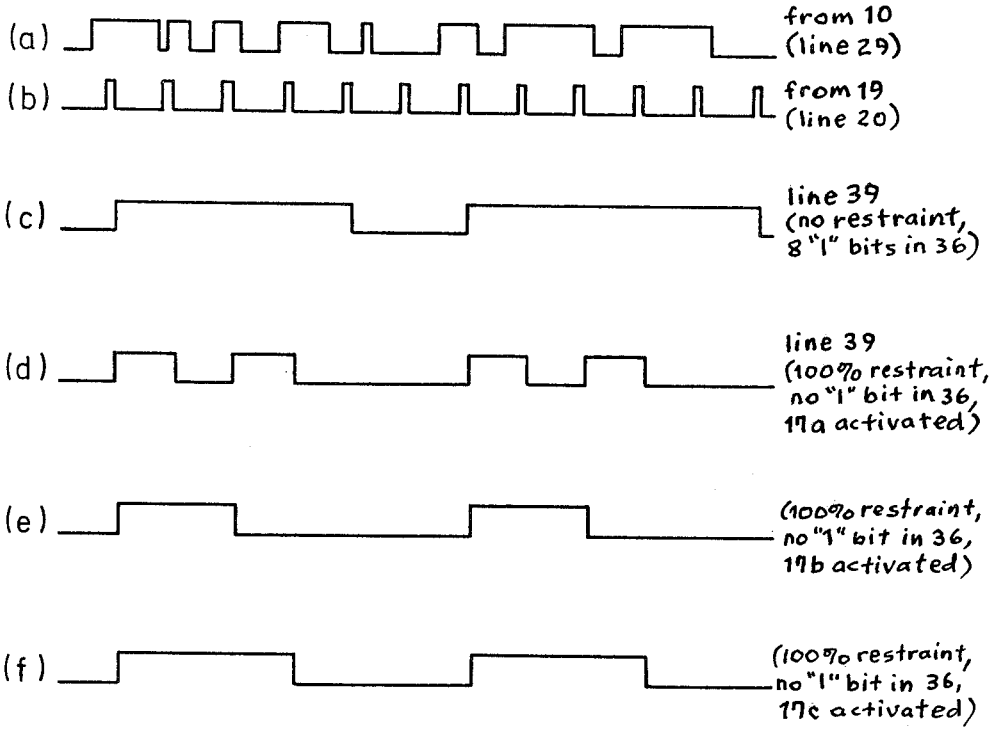
FIG. 4 is a set of signal waveforms referred to in connection with explanation of the operation of the horizontal-direction pattern-limiting unit 11 of FIG. 3.

FIG. 4 depicts bit waveforms to which reference may be made in connection with the foregoing explanation. Bit waveform (a) indicates the bits produced by random signal generator 10 on its output line 29; these are randomly produced and thus the waveform (a) is only exemplary. Waveform (b) represents the train of machine-synchronized pulses applied by machine synchronizer 19 via line 20 to the shift-pulse input of shift register 30 of FIG. 3.

Waveform (c) indicates the pattern-control bits produced on output line 39 of the horizontal-direction pattern-limiting unit 11, for the case that all stages of shift register 36 are loaded with "1" bits, i.e., for the case that no horizontal-direction restraint is imposed upon the randomly generated pattern. As already explained, for this case, the bits registered by stage A of shift register 30 are in effect merely transmitted to output line 39 of unit 11. This can be seen in waveform (c) by the fact that the bit level on output line 39 is at "1" whenever a machine-synchronized pulse of waveform (b) coincides in time with a "1" bit of waveform (a), from random signal generator 10. In the illustrated instance, waveforms (a) and (b) indicate a situation where, by chance, two rather long successions of "1" bits are consecutively registered by stage A of shift register 30, with the result that five or six horizontally consecutive relief stitches happen to be formed.

Waveforms (d), (e) and (f) all correspond to the case where no stage of shift register 36 is loaded with a "1" bit, resulting in maximum horizontal-direction pattern limitation, performed under the control of logic-gate network 38. Waveform (d) indicates, in particular, the case that line 17*a* is activated, to prevent the formation of horizontally adjoining relief stitches. As can be seen, despite the succession of "1" bits registered by stage A of shift register 30, two relief stitches are not formed in immediately adjoining wales of a single course, but instead are separated at least by one wale. Waveform (e) corresponds to activation of line 17*b;* relief stitches in two adjoining wales of the same course are permitted to form. Waveform (f) corresponds to activation of line 17*c;* three, but not more, relief stitches are permitted to form in three adjoining wales of the same course.

For an explanation of FIG. 3, it has been assumed that shift register 36 stores no "1" bits at all (maximum horizontal-direction patterning restraint, imposed selectably by logic-gate network 38) or is fully loaded with "1" bits (no horizontal-direction patterning restraint whatsoever). By loading shift register 36 to an intermediate level, e.g., 50% loaded with "1" bits, one can alternate between these two different modes of operation.

The output line 39 of the horizontal-direction pattern-limiting unit 11 of FIG. 3 is, as shown in FIG. 1, connected to an input of the vertical-direction pattern-limiting unit 12. The internal configuration of unit 12 is shown in FIG. 6.

The vertical-direction pattern-limiting unit 12 serves to place limits upon the number of relief stitches which can be formed in immediately successive courses in a single wale. Whereas the horizontal-direction pattern-limiting unit 11 need not be informed of what pattern-control pulses are being applied by any pattern-control subsystem other than the one actually associated with it, the vertical-direction pattern-limiting unit 12 must be informed of what other subsystems, associated with other courses, are doing. Accordingly, as shown in FIG. 1, the vertical-direction patterning-limiting units 12, 12', etc., are interposed between adjoining shift registers in the endless chain of shift registers 14/1 through 14/36.

Figure 6:
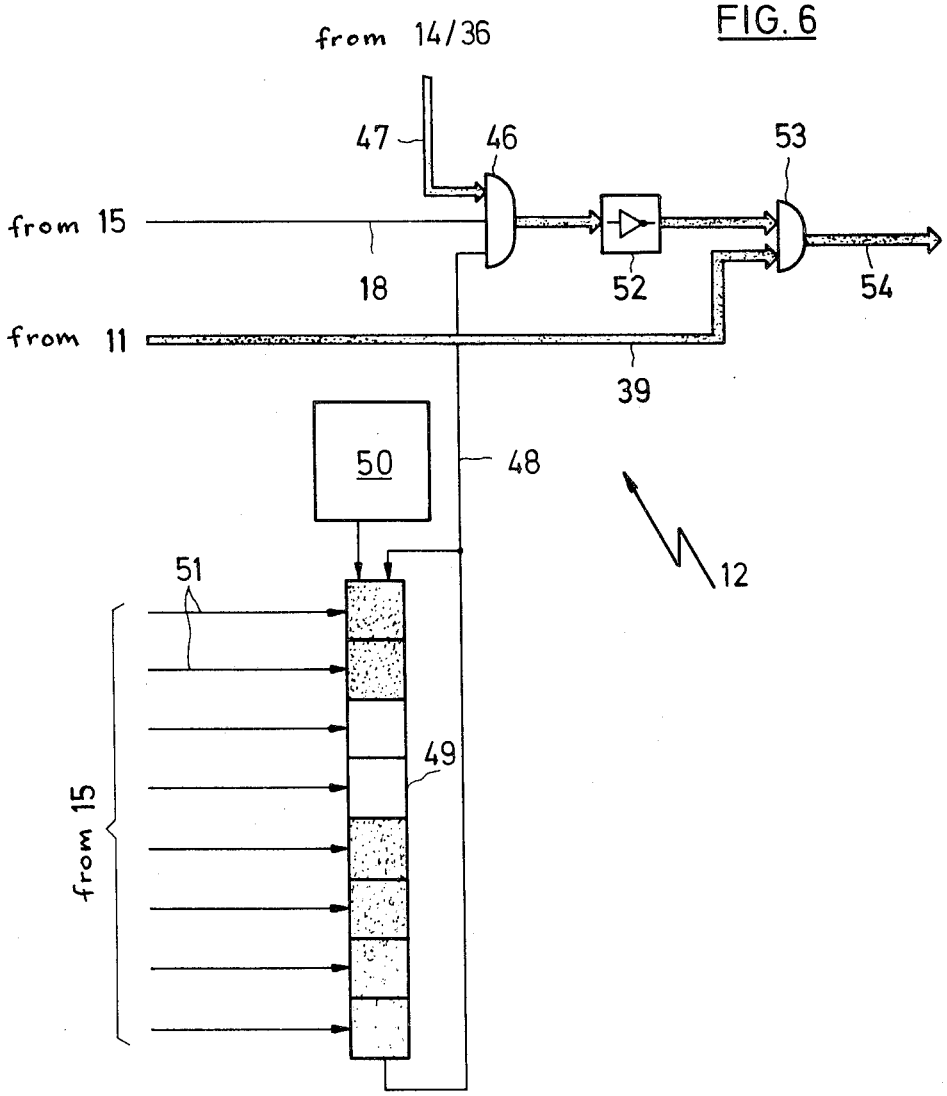
FIG. 6 depicts the internal configuration of the vertical-direction pattern-limiting unit 12 of FIG. 1.

As shown in FIG. 6, the vertical-direction pattern-limiting unit 12, associated with the needle-selector mechanisms S1, S2, S3 of the first three knitting stations, comprises an AND-gate 46 having three inputs. The upper input is connected via a line 47 to the data output of the terminal shift-register stage of the preceding shift register 14/36. The middle input of AND-gate 46 is connected via line 18 to the central keyboard unit 15 of FIG. 1. The bottom input of AND-gate 46 is connected via a line 48 to the data output of the terminal stage of another recirculating shift register 49. Shift pulses are applied to shift register 49 by a further pulse generator 50 of its own, again not synchronized with the other such pulse generators. Again, the degree to which shift register 49 is loaded with "1" bits is determined by a selector switch or keys at keyboard unit 15, via lines 51. In the illustrated instance, the eight-stage register 49 is loaded with only six "1" bits, and at the illustrated moment these occupy the first, second, and fifth through eighth stages of the register.

The output of AND-gate 46 is connected via an inverter 52 to the upper input of an AND-gate 53, whose lower input is connected to the output line 39 of the first, horizontal-direction pattern-limiting unit 11 of the subsystem. The output line 54 of AND-gate 53 is, as shown in FIG. 1, connected to the data input of the first stage of shift register 14/1, and also via inverter 13 to the electromechanical needle selector S1 of the first knitting station.

The pattern-control bit received from output line 39 of horizontal-direction pattern-limiting unit 11 is transmitted through AND-gate 53, if an enabling "1" signal is present at the upper input of AND-gate 53. Let it be assumed that AND-gate 46 is enabled, i.e., is in receipt of "1" signals at its middle and bottom inputs. When a pattern-control bit (either "0" or "1") arrives from pattern-limiting unit 11, the upper input of AND-gate 46 concurrently receives a bit indicating whether a relief stitch was or was not formed in the immediately preceding course in the same wale, a "1" bit indicating that a relief stitch was formed. This "1" bit is inverted by inverter 52 and disables AND-gate 53, so that if the pattern-control pulse from unit 11 happens to be a "1" it does not become transmitted to output line 54. Accordingly, the illustrated vertical-direction pattern-limiting unit 12 prevents the formation of relief stitches in immediately successive courses in the same wale; instead a relief stitch in any given wale is followed by a simple stitch in the next course.

If no "1" bits at all are loaded into shift register 49, then a "0" signal is persistently applied to the bottom input of AND-gate 46, so that the latter persistently produce an output "0" signal, which inverted by inverter 52 maintains AND-gate 53 persistently enabled. Accordingly, the pattern-control bits from unit 11 are merely transmitted to output line 54 and no vertical-direction restraint at all is placed upon the pattern.

By changing the degree to which shift register 49 is loaded with "1" bits, it becomes possible to alternate between these two modes of operation, and to alter the frequency of such alternation.

The pattern-control bit produced on output line 54 is transmitted, via the inverter 13 of FIG. 1, to the needle-selector mechanism S1 of the first knitting station, and via shift register 14/1 and 14/2 to the needle-selector mechanisms 52 and 53 of the next two kniting stations, so that the bit in question reach the needle-selector mechanisms of these next two stations after delays corresponding to the times needed for the needle affected to reach these next two needle-selector mechanisms. In the explanatory instance, the system configuration is set up for double-relief patterning, so that when a "1" bit is applied to needle-selector mechanism S1 for selection or control of a particular needle, "0" bits are applied to needle-selector mechanism S2 and S3 for the selection or control of that same needle; this condition is implemented by inverter 13.

Finally, the pattern-control bit is transmitted, via shift register 14/3, to the vertical-direction pattern-limiting unit 12′ of the second pattern-control subsystem, which operates in the same way.

As will be clear, if desired, the vertical-direction pattern-limiting unit 12, like the borizontal-direction pattern-limiting unit 11, can be provided with an appropriate logic-gate network, for numerical selectability of the maximum number of courses in which relief stitches are to be permitted to adjoin in the same wale.

In the explanatory example involving a double-relief pattern, each course is knitted by three successive knitting stations in cooperation. In the case of a single-relief pattern, for example, each course would be knitted by each two adjoining knitting stations in cooperation. In that case, eighteen, not twelve subsystems would be required, and the vertical-direction pattern-limiting unit 12′ of the second subsystem would be connected between the shift registers 14/2 and 14/3, instead of 14/3 and 14/4; and so forth. With two stations per subsystem, if a two-color patterning technique, instead of a relief patterning technique is involved, the use of the inverter 13 is sufficient to assure that only one of the two cooperating stations form a stitch in any particular wale and course. Other such modifications, e.g., involving multicolor patterning, knit-and-tuck patterning, etc., will be self-evident to persons skilled in the art.

It will be understood that each of the elements described above, or two or more together, may also find a useful application in other types of methods and control systems, differing from the types described above.

While the invention has been illustrated and described as embodied in a method and system for knitting a double-relief pattern on a circular knitting machine with horizontal-direction and vertical-direction patterning restraints involving the number of adjoining relief stitches to be formed, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In combination with a fabric-producing machine of the type provided with patterning means responsive to pattern-control signals, a patterning system which implements a non-repeating pattern, the patterning system comprising means generating pattern-control signals randomly and comprising a plurality of means each randomly generating pattern-control signals for a different part of the fabric produced and operating independently of one another and each comprising a respective multi-state signal storage means and a respective pulse generator controlling the storage means, the pulse generators operating independently of one another.

2. The combination defined in claim 1, each multi-state signal storage means comprising a circulating shift register.

3. In combination with a fabric-producing machine of the type provided with patterning means responsive to pattern-control signals, a patterning system which implements a non-repeating pattern, the patterning system comprising means generating pattern control signals randomly and comprising a plurality of means each randomly generating pattern-control signals for a different part of the fabric produced and operating independently of one another and each comprising two multi-state signal storage means, two pulse generators operating independently of each other and independently of the other pulse generators and driving a respective one of the associated two multi-state signal storage means and a respective gating means connected to the two multi-state signal storage means and producing output signals in dependence upon the combined states of the two multi-state signal storage means.

4. The combination defined in claim 3, furthermore including user-operated selecting means operative for preselecting the states which the multi-state signal storage means assumes when driven by the respective pulse generators.

5. In combination with a knitting machine of the type provided with patterning means responsive to pattern-control signals to produce fabric comprised of courses and wales, a patterning system which implements a non-repeating pattern, the patterning system comprising means generating pattern-control signals randomly; and pattern-limiting means operative for automatically imposing predetermined patterning restraints upon the pattern-control signals produced and comprising means limiting the number of immediately consecutive adjoining identical stitches formed in a course.

6. In combination with a knitting machine of the type provided with patterning means responsive to pattern-control signals to produce fabric comprised of courses and wales, a patterning system which implements a non-repeating pattern, the patterning system comprising means generating pattern-control signals randomly; and pattern-limiting means operative for automatically imposing prdetermined patterning restraints upon the pattern-control signals produced and comprising means limiting the number of immediately consecutive adjoining identical stitches formed in a wale.

7. In combination with a knitting machine of the type provided with patterning means responsive to pattern-control signals to produce fabric comprises of courses and wales, a patterning system which implements a non-repeating pattern, the patterning system comprising means generating pattern-control signals randomly; and pattern-limiting means operative for automatically imposing predetermined patterning restraints upon the pattern-control signals produced and including multi-stage register means registering a succession of pattern-control signals, whereby to register information concerning a portion of the patterned fabric which would result from the succession of pattern-control signals, and means connected to the multi-stage register means and operative for changing at least one pattern-control signal in dependence upon whether the succession of pattern-control signals registered by the multi-stage register does or does not meet at least one predetermined criterion.

8. The combination defined in claim 7, the multi-stage register means comprising a multi-stage shift register having a data input connected to receive the pattern-control signals, successive pattern-control signals being transmitted serially through the multi-stage shift register, the means for changing at least one of the pattern-control signals comprising a decoder having inputs connected to individual stages of the shift register and having outputs and a logic-gate network having inputs connected to the outputs of the decoder.

9. The combination defined in claim 8, furthermore including multi-state signal storage means and pulse generator means driving the signal storage means, and means connected to the shift register and to the storage means and operative for causing at least one of the stages of the shift register to register a pattern-control signal determined by the state of the multi-state signal storage means, and furthermore including selecting means for preselecting the states which the storage means will assume when driven by the pulse generator means.

10. The combination defined in claim 9, the multi-state signal storage means being a circulating shift register.

11. In combination with a knitting machine of the type provided with patterning means responsive to pattern-control signals to produce fabric comprised of courses and wales, a patterning system which implements a non-repeating pattern, the patterning system comprising means generating pattern-control signals randomly; and pattern-limiting means operative for automatically imposing predetermined patterning restraints upon the pattern-control signals produced and including first pattern-limiting means receiving pattern-control signals for successive stitches of the same wale, said pattern-limiting means being operative for changing at least one of the pattern-control signals in dependence upon whether the pattern-control signals do or do not meet at least one predetermined criterion respectively relating to consecutive stitches in one course and to consecutive stitches in one wale.

12. The combination defined in claim 11, furthermore including multi-state signal storage means, pulse generator means driving the multi-state signal storage means, and selecting means for selecting the states which the signal storage means will assume when driven by the pulse generator means, and means connected to the signal storage means and to the second pattern-limiting means and operative for modifying the operation of the second pattern-limiting means in dependence upon the state of the multi-state signal storage means.

* * * * *